US007896437B2

(12) United States Patent
Donovan

(10) Patent No.: US 7,896,437 B2
(45) Date of Patent: Mar. 1, 2011

(54) ROCKER-RECLINER BASE ASSEMBLY HAVING UNITARY CAM MEMBERS

(75) Inventor: Robert Dean Donovan, Mooreville, MS (US)

(73) Assignee: L & P Property Management Company, South Gate, CA (US)

( * ) Notice: Subject to any disclaimer, the term of this patent is extended or adjusted under 35 U.S.C. 154(b) by 249 days.

(21) Appl. No.: 11/964,937

(22) Filed: Dec. 27, 2007

(65) Prior Publication Data

US 2009/0166484 A1 Jul. 2, 2009

(51) Int. Cl.
*A47C 3/027* (2006.01)

(52) U.S. Cl. ..... 297/265.1; 297/261.1; 297/258.1; 297/DIG. 7

(58) Field of Classification Search ..... 297/DIG. 7, 297/271.5, 261.3, 261.2, 261.1, 463.2, 463.1, 297/259.2, 258.1, 265.1, 272.1, 271.6
See application file for complete search history.

(56) References Cited

U.S. PATENT DOCUMENTS

| | | | | |
|---|---|---|---|---|
| 1,682,685 | A | 8/1928 | Rodery | |
| 1,986,233 | A | 1/1935 | Weaver | |
| 3,158,877 | A | 12/1964 | Cooper | |
| 3,462,190 | A * | 8/1969 | Campbell | 297/85 R |
| 5,839,781 | A | 11/1998 | Knape | |
| 6,000,750 | A | 12/1999 | Rossman et al. | |
| 6,918,632 | B2 | 7/2005 | Maki et al. | |
| 7,252,334 | B2 * | 8/2007 | Hale et al. | 297/265.1 |
| 2006/0232113 | A1 * | 10/2006 | Hale et al. | 297/258.1 |

* cited by examiner

*Primary Examiner* — David Dunn
*Assistant Examiner* — Tania Abraham
(74) *Attorney, Agent, or Firm* — Shook, Hardy & Bacon LLP

(57) ABSTRACT

A rocker chair base assembly employs a set of unitary composite cam members to enable a user to engage in a rocking motion with a chair mounted over the assembly. Each cam member presents a rigid body with a set of laterally projecting sleeves. A first set of angle cross members serve to interconnect longitudinal rails on which the cam members reside, and a second set of angle cross members serve to interconnect adjacent cam members. Specifically, the laterally projecting sleeves of each cam member present a mating angle profile for slidably receiving therein and securely attaching with longitudinal end regions of the second set of angle cross members.

10 Claims, 2 Drawing Sheets

ROCKER-RECLINER BASE ASSEMBLY HAVING UNITARY CAM MEMBERS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Rocker chairs, including recliners with a rocking feature, typically have a base assembly for supporting the superstructure of the chair on a floor. As an example, rocker chairs may include various linkage systems for supporting a seat frame, a footrest, and other chair occupant support structures through movements of the chair from an upright seated position to partially and fully reclined positions, and back. Additionally, such chairs often employ a rocking motion limiting mechanism. Over time, the rocking motion limiting mechanism of a typical rocker chair encounters many stress cycles and becomes prone to fatigue failure. For instance, if compression or extension springs are utilized in the rocking motion limiting mechanism, the many cycles of stretch or elongation of the spring body may eventually lead to structural failure. One way to handle this issue is to utilize a more substantial spring (e.g., larger diameter wire) in the design of the rocking motion limiting mechanism. However, a significant drawback of larger springs is increased force that is require to stretch the spring, which can impede the chair occupant's ability to engage in a rocking motion. As a result, it has proven difficult to provide a rocker chair design that is easy for the user to "rock" while providing to be reliable over time.

SUMMARY OF THE INVENTION

A brief overview of the rocker chair base assembly and its components follows immediately below. A more detailed description is provided in the Detailed Description of the Invention section.

Embodiments of the present invention provide a rocker chair (rocker-recliner) base assembly employing a set of unitary composite cam members to enable a user to engage in a rocking motion with a chair mounted over the assembly.

In one aspect, the rocker chair base assembly includes first and second sets of angle cross members for interconnecting both the set of composite cam members and a set of spaced apart longitudinal rails upon which the cam members are located for rolling contact therewith during a rocking motion. Each composite cam member is formed of a rigid body and a set of projecting sleeves extending laterally from the rigid body. The rigid body is formed with a lower contact surface presenting an arcuate longitudinal profile, enabling the rolling contact on an upper engagement surface of one of the longitudinal rails. Each sleeve is configured to present a mating angle profile for slidably receiving therein and securely attaching with longitudinal end regions of the second set of angle cross members, thereby interconnecting one composite cam member of the set of composite cam members with another composite cam member of the set of composite cam members. Additionally, a rocking motion limiting mechanism is securely attached to the first set of angle cross members and to the set of projecting sleeves of each composite cam member, thereby coupling the composite cam members to the first set of angle cross members for securely positioning the composite cam members on the longitudinal rails.

Additional features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION OF THE INVENTION

Figure 1:
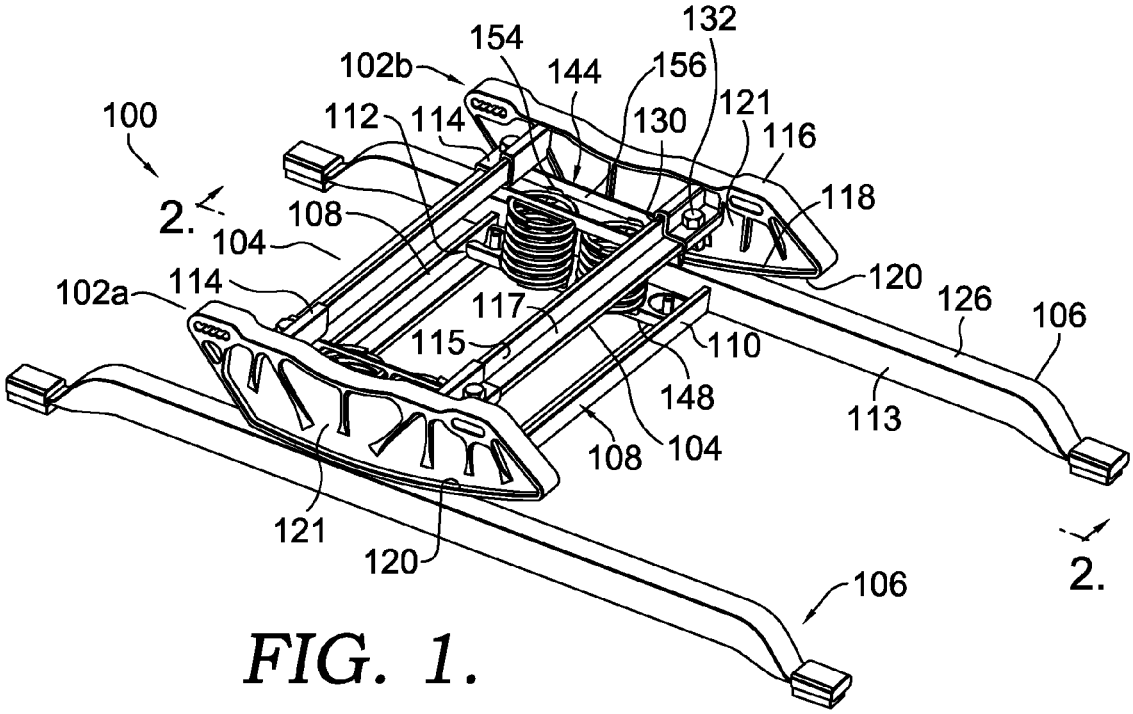
FIG. 1 is a perspective view of a rocker chair base assembly incorporating a set of unitary cam members in accordance with one embodiment of the present invention.
Figure 2:
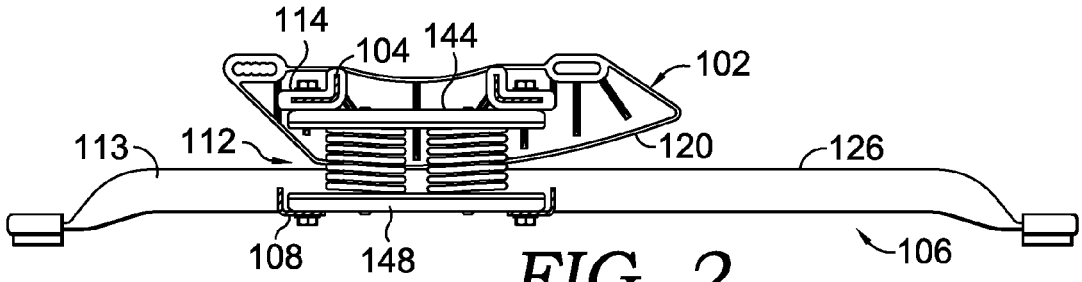
FIG. 2 is a side elevational view of the rocker chair base assembly incorporating the unitary cam members.

Turning now to the drawings, and in particular to FIGS. 1 and 2, a rocker chair base assembly 100 is illustrated that incorporates a set of unitary cam members 102, also referred to herein as cam members 102*a* and 102*b*. The cam members 102 are interconnected with one another through a set of upper cross members 104 for proper positioning of each cam member 102 upon one of a set of parallel longitudinal rails 106 of the base assembly 100. In this way, the longitudinal rails support a forward and rearward rocking motion on the rails 106 by the cam members 102, with the cam members 102 supporting the weight of the chair frame and other superstructure of a rocker-recliner chair (not shown). The rocker chair base assembly 100 further includes a set of lower cross members 108 connected on opposed longitudinal ends 110 with the longitudinal rails 106 and a set of rocking motion limiting mechanisms, for instance, in the form of rocker spring assemblies 112. Each rocker spring assembly 112 interconnects the lower cross members 108 with the upper cross members 104 and thereby indirectly couples the cam members 102*a* and 102*b* with the rails 106 as explained more fully herein. The cross member longitudinal ends 110 may be attached to opposed side regions 113 of each longitudinal rail 106 by welding or other attachment means. In one embodiment, the upper and lower cross members 104 and 108 are each formed as longitudinally extending "L" shaped angle members with a vertical flange portion 115 and a horizontal flange portion 117 joined along a common bend. The horizontal flange portion 117 is preferably attached with each longitudinal rail side region 113 at an elevation significantly lower than the elevation of an upper engagement surface 126 of the respective rail 106 upon which the cam members 102 engage in the forward and rearward rocking motion. This provides the advantage of a lower seating for the rocker spring assemblies 112, the benefits of which are more fully explained herein. However, in certain embodiments, it should be understood that the upper and lower cross members 104 and 108 may possess a variety of cross-sectional angle configurations, such as those generally referred to as "J" shaped, "U" shaped, "Z" shaped, or other configurations.

The cam members 102 are preferably formed as rigid composite structures from polymeric material. For instance, the cam members 102 may be formed of glass-filled nylon, polypropylene, or a combination of the these materials. Other materials may be selected as a matter of design choice. The composite cam members 102 may be formed by molding processes, such as injection molding, and certain portions of the cam members 102 may be machined to form the finished product. The composite nature of the cam members 102 allow for improved integration into a rocker chair base assembly 100, resulting in shorter assembly times and a more reliable product. The use of composite materials enables the cam members 102 to be manufactured to tight tolerances and with consistent material properties throughout the structure. Furthermore, composite cam members provide the advantage of being able to withstand repeated loading cycles while maintaining sufficient structural integrity.

Figure 3:
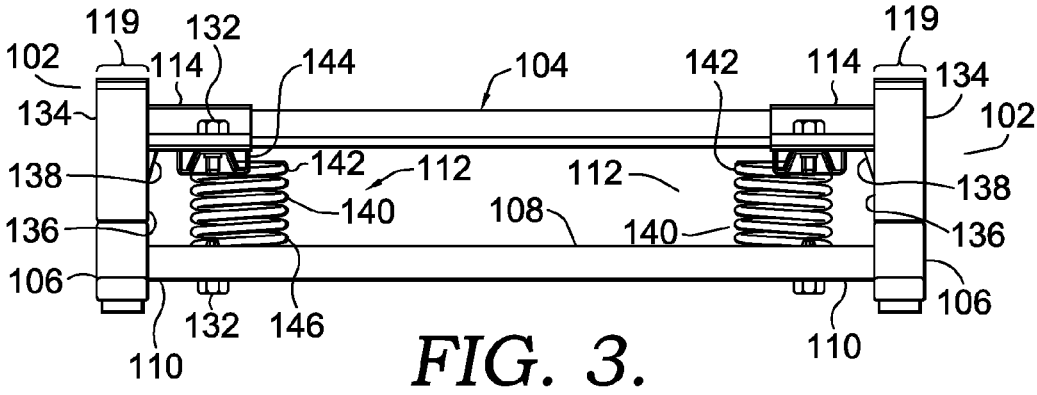
FIG. 3 is a front elevational view of the rocker chair base assembly incorporating the unitary cam members.

With continued reference to FIGS. 1 and 2, and additional reference to FIGS. 3 and. 4, each of the cam members 102 has a main body 119 and a set of projecting sleeves 114 extending laterally from the main body 119. In one embodiment, the projecting sleeves 114 present a mating angle profile for accepting a longitudinal end regions 130 of one of the upper cross members 104, and in particular, a member 104 having the vertical flange portion 115 and horizontal flange portion 117. The main body 119 of each cam member 102 includes an upper portion 116 from which the sleeves 114 project, a lower portion 118 where a contact surface 120 is formed, and a vertically oriented web 121 spanning between the upper portion 116 and the lower portion 118. The web 121 has a plurality of strengthening ribs 122 extending generally from the upper portion 116 to a location at or near the lower portion 118 to aid in carrying the vertical load induced by the chair occupant and the weight of the chair. Preferably, some or all of the ribs 122 do not extend downwardly to the contact surface 120, as typical molding processes for the cam member 102 could result in the ribs 122 creating small deflections in the contact surface 120 that may be felt by the chair occupant during a rocking motion on the longitudinal rails 106.

For a smooth rocking motion, the contact surface 120 of the cam member 102 has an arcuate longitudinal profile. As such, the contact surface 120 is configured to move in rolling engagement with a top surface 126 of the longitudinal rails 106. Optionally, a powder coat may be applied to the top surface 126 of the longitudinal rails 106 in order to increase the friction between the top surface 126 and the contact surface 120 to reduce slippage during rocking.

Laterally oriented through holes 128 are generally positioned at the upper portion 116 of the main body 119 to serve as attachment points for a rocker-recliner chair frame to couple with the rocker chair base assembly 100 through each cam member 102. For instance, fasteners (not shown) may be inserted into through holes 128 and through a feature of the rocker-recliner chair frame to accomplish coupling with the rocker chair base assembly 100. Those of skill in the art will appreciate that other attachment means may be selected.

In assembly, the longitudinal end regions 130 of the upper cross members 104 are inserted into the sleeves 114 and vertically oriented apertures (not shown) of both the upper cross members 104 and the sleeves 114 are aligned so that a fastener 132 inserted therethrough secures one of the upper member end regions 130 within one of the sleeves 114. Specifically, in one embodiment, the vertically oriented apertures are formed in the horizontal flange portion 117 of the upper cross members 104 for accepting the fasteners therethrough. This particular design also ensures proper lateral alignment between the contact surface 120 of the cam member 102 and the top surface 126 of the longitudinal rails 106 by selecting upper cross members 104 of an appropriate length. It should be understood that the term "sleeve" as used herein may refer to both a sleeve that completely circumscribes or surrounds the upper member end region 130 or a sleeve that partially surrounds the upper member end region 130. Accordingly, in embodiments, the sleeve 114 may surround both the top and bottom sides of the horizontal flange portion 117 of the upper cross members 104, or may overlie either the top or bottom sides of the portion 117.

In one embodiment of the rocker chair base assembly 100 illustrated in FIG. 1, one of the cam members 102*a* has sleeves 114 projecting laterally to the left and the other cam member 102*b* has sleeves 114 projecting laterally to the right (according to the orientation of a chair occupant), so that the sets of sleeves 114 on the opposed cam members 102*a*, 102*b* are directed towards one another. With additional reference to FIG. 3, outward facing and inward facing lateral side regions 134, 136 of each cam member 102 are generally mirror images of one another, except that the inward facing region 136 includes the sleeves 114 as well as a brace 138 extending from the vertically oriented web 121 to support each sleeve 114.

With continued reference to FIGS. 1-4, in one embodiment, each rocker spring assembly 112 is secured between the sleeves 114 of one cam member 102 and the lower cross members 108 to thereby regulate a rocking motion by the composite cam members 102 on the upper engagement surfaces 126 of the longitudinal rails 106. Specifically, the spring assemblies 112 each include a pair of spring coils 140 with an upper portion 142 thereof coupled with an upper bushing 144 and a lower portion thereof 146 coupled with a lower bushing 148. Each lower bushing 148 spans between the horizontal flange portion 117 of the lower cross members 108 and each upper bushing 144 spans between the sleeves 114 at the point of attachment with the upper cross members 104. The upper bushings 144 and lower bushings 148 each have vertically oriented apertures (not shown) to enable fasteners 132 to be inserted therethrough for mounted to the sleeves 114 and the lower cross members 108, respectively. In one embodiment, the same fasteners 132 that secure the upper cross members 104 and the sleeves 114 together also secure the upper bushings 144 thereto. With respect to the lower cross members 108, vertically oriented apertures (not shown) are formed in the horizontal flange portion 117 of members 108 for alignment with the apertures of the lower bushings 148 and receiving the fasteners therethrough. This design provides the advantage of a single assembly step for mounting both the upper cross members 104 and the upper bushings 144 to the sleeves 114, and mounting the lower cross members 108 with the lower bushings 148, by use of the fasteners 132. Alternatively, in a configuration where the sleeves 114 do not completely circumscribe the upper member end regions 130, and thereby leave the bottom side of the horizontal flange portions 117 of the upper cross members 104 exposed, the upper bushings 144, via fastener 132, connect directly with the horizontal flange portion 117.

In embodiments, by locating the horizontal flange portion 117 of the lower cross members 108 at such a low elevation with respect to each longitudinal rail upper engagement surface 126, the lower seating for the rocker spring assemblies 112 is achieved. Specifically, the lower bushings 148 and the spring coil lower portions 146 are positioned lower than the longitudinal rail upper engagement surface 126, as best seen in FIG. 2. This configuration ensures that excessive spring elongation or extension (stretch) is not encountered during a given range of forward and rearward rocking motions. Additionally, because less spring elongation is required for a given range of rocking motions, less force is required by the chair occupant in order to fully "rock" the chair. In one embodiment, the height or vertical length of the spring coils 140 above the horizontal plane defined by the longitudinal rail upper engagement surface 126 is approximately the same as the height of the spring coils 140 below the same plane. Thus, a vertical midpoint of the spring coils 140 is basically in the same plane as the longitudinal rail upper engagement surface 126. This provides a good balance in that the height centered spring (i.e., vertically centered with respect to the longitudinal rail upper engagement surface 126) achieves less spring elongation, and thus less stress, while still providing a full range of rocker cam motion without excessive resistance to the user's force input.

Figure 4:
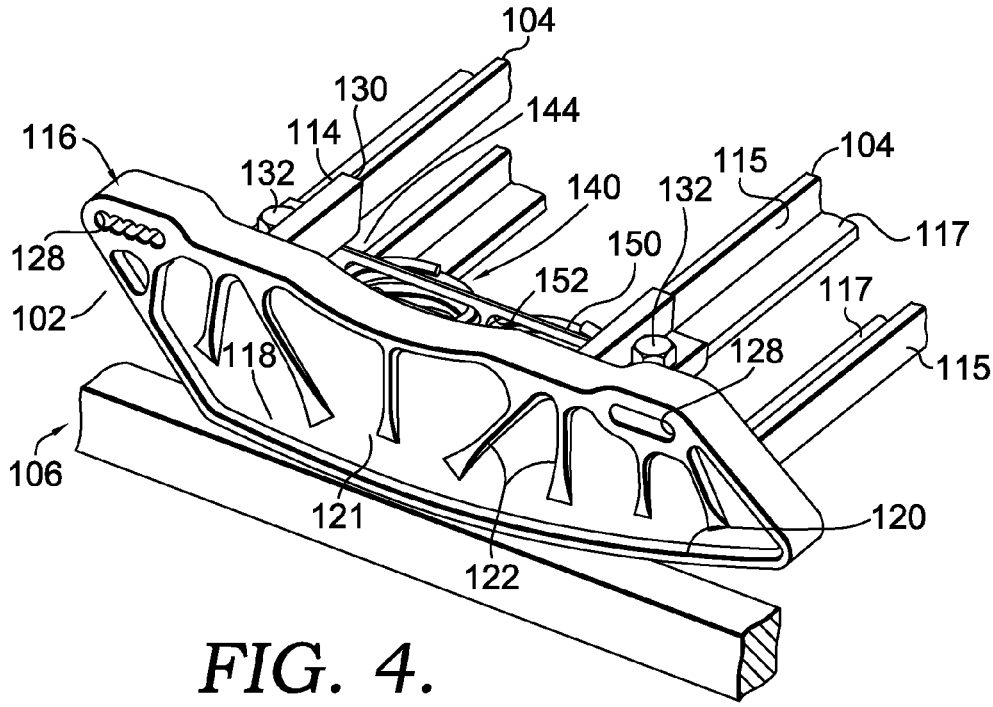
FIG. 4 is a close-up fragmentary perspective view of a portion of the rocker chair base assembly showing one of the unitary cam members.

The coupling of the upper and lower portions 142 and 146 of the spring coils 140 with the respective upper and lower bushings 144 and 148 is best seen in FIGS. 1 and 4. Each of the upper and lower bushings 144 and 148 has a first sidewall 150 formed with an aperture 152 through which the spring coil upper and lower portions 142 and 146 extend, as well as a second sidewall 156. Interconnecting the sidewalls 150 and 156 of each of the upper and lower bushings 144 and 148 is a base portion from which a pair of clips 154 extend. These clips 154 aid in holding the spring coils 140 in place on the bushings 144 and 148.

Those of skill in the art will appreciate that one or more additional cam members 102 and a corresponding number of longitudinal rails 106 may be integrated into the design of the rocker chair base assembly 100. For instance, another parallel longitudinal rail 106 may be positioned between the existing rails 106 with a split in the lower cross members 108 where the additional rail 106 may be located. In such a design, each additional cam member 102 would have sleeves projecting from both outward facing and inward facing lateral side regions 134 and 136, thereby extending in opposed lateral directions. Additionally, multiple rocker spring assemblies 112 (or simply an additional number of spring coils for each pair of upper and lower bushings 144 and 148) may be coupled with each cam member 102 in situations where the projecting sleeves 114 are sufficiently long as to provide appropriate mounting locations for the rocker spring assemblies 112 along the length of the upper cross members 104.

As can be understood, the unitary cam member 102 design of the present invention provides a durable product that is well integrated with other components of a rocker chair base assembly 100. The cam members 102 facilitate ease of manufacture of a rocker chair base assembly 100 with a reliably positioned interface between the cam member contact surface 120 and the longitudinal rails 106 which support the rocking motion.

Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. A rocker chair base assembly, comprising:

a pair of parallel-spaced longitudinal rails, each rail including an upper engagement surface and side regions;

a pair of unitary, single piece composite cam members, each formed of:

a rigid body having an upper portion and a lower portion, the lower portion including a lower contact surface presenting an arcuate longitudinal profile enabling rolling contact on the upper engagement surface of one longitudinal rail of the pair of longitudinal rails; and a vertically oriented web spanning between the upper portion and the lower portion, wherein the web includes a plurality of strengthening ribs, each of the plurality of strengthening ribs extending from the upper portion to a location near the lower portion, wherein each of the plurality of strengthening ribs does not extend downwardly to the lower contact surface;

a first set of angle cross members interconnecting said pair of cam members, wherein each of said first set of angle cross members is disposed below the upper portion of each of said cam members;

a second set of angle cross members interconnecting said pair of longitudinal rails, each having opposed longitudinal end regions, wherein each of said second set of angle cross members is disposed at a lower elevation than each of said first set of angle cross members, wherein each of said cam members further includes:

a set of projecting sleeves extending laterally from the rigid body at a location generally above the lower contact surface, each sleeve of the set of projecting sleeves being configured to present a mating angle profile for slidably receiving therein and securely attaching with the longitudinal end regions of the first set of angle cross members, thereby interconnecting one composite cam member of the set of composite cam members with another composite cam member of the set of composite cam members and positioning the first set of angle cross members generally above the second set of angle cross members; and at least one rocker spring assembly including at least one spring coil, each rocker spring assembly being securely coupled with the first set of angle cross members and the set of projecting sleeves of the respective composite cam member and the second set of angle cross members;

wherein a lower portion of the at least one spring coil of the at least one rocker spring assembly is disposed at a lower elevation than the engagement surface of each longitudinal rail such that a vertical midpoint of the spring coil lies in a horizontal plane defined by the engagement surface of each longitudinal rail when the assembly is in a neutral position; and wherein the at least one rocker spring assembly serves to regulate a rocking motion by the set of composite cam members on the pair of longitudinal rails and to couple the set of composite cam members to the second set of angle cross members for securely positioning the set of cam members on the pair of longitudinal rails.

2. The assembly of claim 1, wherein the first set of angle cross members and the second set of angle cross members are each generally L-shaped.

3. The assembly of claim 1, wherein the at least one rocker spring assembly includes:

a first rocker spring assembly formed of:

an upper bushing and lower bushing, the upper bushing connected with the set of projecting sleeves of one composite cam member of the set of composite cam members and with the first portion of the first set of angle cross members, wherein the at least one spring coil is mounted with and spans between the set of upper and lower bushings; and a second rocker spring assembly formed of:

an upper bushing and lower bushing, the upper bushing connected with the set of projecting sleeves of another one of the composite cam members of the set of composite cam members and with the first portion of the first set of angle cross members, wherein the at least one spring coil is mounted with and spans between the set of upper and lower bushings.

4. The assembly of claim 3, wherein the first portion of the first set of angle cross members is formed as a horizontal flange portion, and wherein the set of lower bushings of each of the first rocker spring assembly and second rocker spring assembly are mounted directly onto the horizontal flange portion.

5. The assembly of claim 1, wherein the sets of projecting sleeves of adjacent composite cam members of the set of composite cam members extend toward one another upon attaching the longitudinal end regions of the second set of angle cross members with the sets of projecting sleeves.

6. A rocker chair base assembly, comprising:

a set of longitudinal rails spaced from one another, each rail including an upper engagement surface and side regions, the upper engagement surface being powder coated to increase frictional properties thereof;

a pair of unitary, single piece composite cam members, each formed of:

a rigid body having a lower contact surface presenting an arcuate longitudinal profile enabling rolling contact on the upper engagement surface of one longitudinal rail of the set of longitudinal rails; and a set of projecting sleeves extending laterally from the rigid body at a location generally above the lower contact surface, each sleeve of the set of projecting sleeves being configured to present a mating angle profile for slidably receiving therein and securely attaching with the longitudinal end regions of a first set of angle cross members, thereby interconnecting one composite cam member of the set of composite cam members with at least one adjacent composite cam member of the set of composite cam members and positioning the first set of angle cross members generally above a second set of angle cross members;

the first set of angle cross members interconnecting said pair of cam members, wherein each of said first set of angle cross members is disposed below an upper portion of each of said cam members;

the second set of angle cross members interconnecting at least two of said set of longitudinal rails, each angle cross member of the second set having opposed longitudinal end regions, wherein each of said second set of angle cross members is disposed at a lower elevation than each of said first set of angle cross members; and at least one rocker spring assembly including at least one spring coil, each rocker spring assembly being securely coupled with the first portion of the first set of angle cross members and the set of projecting sleeves of the respective composite cam member and the second set of angle cross members;

wherein a lower portion of the at least one spring coil of the at least one rocker spring assembly is disposed at a lower elevation relative to the engagement surface of each longitudinal rail such that a vertical midpoint of the spring coil lies in a horizontal plane defined by the engagement surface of each longitudinal rail when the assembly is in a neutral position thereby achieving less spring elongation and less stress on the at least one spring coil compared to a configuration in which the vertical midpoint of the at least one coil spring is located at a higher elevation relative to the engagement surface of each longitudinal rail; and wherein the at least one rocker spring assembly serves to regulate a rocking motion by the set of composite cam members on the set of longitudinal rails and to couple the set of composite cam members to the second set of angle cross members for securely positioning the set of cam members on the set of longitudinal rails.

7. The assembly of claim 6, wherein the first set of angle cross members and the second set of angle cross members are each generally L-shaped.

8. The assembly of claim 6, wherein:

the at least one rocker spring assembly includes a first rocker spring assembly and a second rocker spring assembly;

the set of longitudinal rails includes a pair of parallel-spaced longitudinal rails such that the first set of angle cross members interconnect the pair of longitudinal rails; and the first rocker spring assembly being formed of:

an upper bushing and lower bushing, the upper bushing connected with the set of projecting sleeves of one composite cam member of the set of composite cam members and with the first portion of the first set of angle cross members, wherein the at least one spring coil is mounted with and spans between the set of upper and lower bushings, a second rocker spring assembly formed of:

an upper bushing and lower bushing, the upper bushing connected with the set of projecting sleeves of another one of the composite cam members of the set of composite cam members and with the first portion of the first set of angle cross members, wherein the at least one spring coil is mounted with and spans between the set of upper and lower bushings.

9. The assembly of claim 8, wherein the first portion of the first set of angle cross members is formed as a horizontal flange portion, and wherein the set of lower bushings of each of the first rocker spring assembly and second rocker spring assembly are mounted directly onto the horizontal flange portion.

10. The assembly of claim 6, wherein the sets of projecting sleeves of adjacent composite cam members of the set of composite cam members extend toward one another upon attaching the longitudinal end regions of the second set of angle cross members with the sets of projecting sleeves.

* * * * *